United States Patent [19]

VanDerStuyf et al.

[11] Patent Number: 4,722,704

[45] Date of Patent: Feb. 2, 1988

[54] HIGH DENSITY SOCKET CONTACT RECEPTACLE

[75] Inventors: Allen F. VanDerStuyf, Kernersville; Earl J. Hayes, Advance, both of N.C.

[73] Assignee: AMP Incorporated, Harrisburg, Pa.

[21] Appl. No.: 873,652

[22] Filed: Jun. 12, 1986

[51] Int. Cl.[4] ..... H01R 13/11

[52] U.S. Cl. ..... 439/851

[58] Field of Search ..... 339/256 R, 256 C, 258 R; 439/842, 851, 852, 856, 857

[56] References Cited

U.S. PATENT DOCUMENTS

| | | | |
|---|---|---|---|
| 3,317,887 | 5/1967 | Henschen et al. | 339/256 |
| 3,862,792 | 1/1975 | Jayne | 339/258 R X |
| 4,002,400 | 1/1977 | Evans | 339/256 R |
| 4,175,821 | 11/1979 | Hunter | 339/258 R X |
| 4,298,242 | 11/1981 | McKee | 339/258 R X |
| 4,550,972 | 11/1985 | Romak | 339/256 R |
| 4,591,230 | 5/1986 | Roldan | 339/258 R |

*Primary Examiner*—John McQuade

*Attorney, Agent, or Firm*—Eric J. Groen

[57] ABSTRACT

An electrical connector assembly includes a mating receptacle and header. The receptacle includes contacts having beam members integral with and extending between a forward and rearward cylindrical portion. The beam members are formed in opposed pairs with constricted portions at different axial locations. The spacing between the opposed pairs of beams is less than the widths of the beams. The header includes rows of square posts for mating with the socket contacts, the rows of posts being axially offset from each other.

10 Claims, 17 Drawing Figures

72a
70a
70a
72a 66a
66a
90

68a
68a 76a
66a
72a
76a
66a
72a

HIGH DENSITY SOCKET CONTACT RECEPTACLE

BACKGROUND OF THE INVENTION

1. Field of the Invention

The instant invention relates to a high density receptacle having socket contacts, the receptacle interconnectable with pin contacts mounted within a header.

2. Description of the Prior Art

Headers and panel boards containing a rectangular matrix of electrically conductive schemes in a variety of applications. The posts are generally aligned in a closely spaced array or matrix of identical posts. These posts normally have either a square or a round cross section. Conventional applications in which an array of posts might be employed would include automotive applications, computers, televisions and telecommunications systems.

Posts in an array are generally closely spaced and this spacing is generally dictated by consideration other than the geometry of the connector. Therefore, terminals and connectors must be designed to function on the centerline spacings dictated. Even where the post array and the connector can be designed as a system, there is a real need to employ standard rather than unique configurations.

A conventional approach to interconnecting a wire to an individual post or pin in an array of posts is to employ a contact socket of the type generally shown in U.S. Pat. No. 3,317,887. A contact of this type includes four beams oriented in opposed pairs of beams. These beams are stamped from an integral spring metal blank and the blank is formed around a central axis to form a box or cylindrical configuration. The beams are inwardly formed with the interior of each beam having a generally convex configuration. Constructed areas of each beam are at the same axial location and upon insertion of a post or pin, the beams are simultaneously outwardly deflected and points of contact are established at the constructed points. However, since all four beams are simultaneously deflected, the relative contact force can be quite high. Deflection of the beams is also limited since the spacing between the beams in the constructed area of each pair of opposed beams can be no closer than the widths of the adjacent beams, thus the normal force on the post is minimized.

SUMMARY OF THE INVENTION

It is an object of the present invention to design a socket contact for interconnection with a post member, the contact design allowing for a high density array of connections.

It is an object of the instant invention to design a socket contact having a high normal force given the small envelope of the contact.

It is an object of the present invention to design a socket contact having a low insertion force with a post member.

The instant invention accomplishes the objectives by having a socket contact with beam members integral with and extending between a forward and rearward cylindrical portion, the beam members formed in pairs of opposing members, the beams being formed inwardly forming a first and second constricted portion, the first and second constrictions being axially offset, with the spacing between the opposed beams being less than the width of the beams. The deflection of the beams upon insertion of a post is greater than if the constricted portions were axially aligned leading to a relatively high normal force on the post member. As the constricted portions are axially offset, the insertion force is thereby minimized.

BRIEF DESCRIPTION OF THE DRAWINGS

FIG. 3 is a perspective view of the receptacle cutaway with the socket contacts inserted and the terminal positioning insert exploded away.

DETAILED DESCRIPTION OF THE PREFERRED EMBODIMENT

Figure 1:
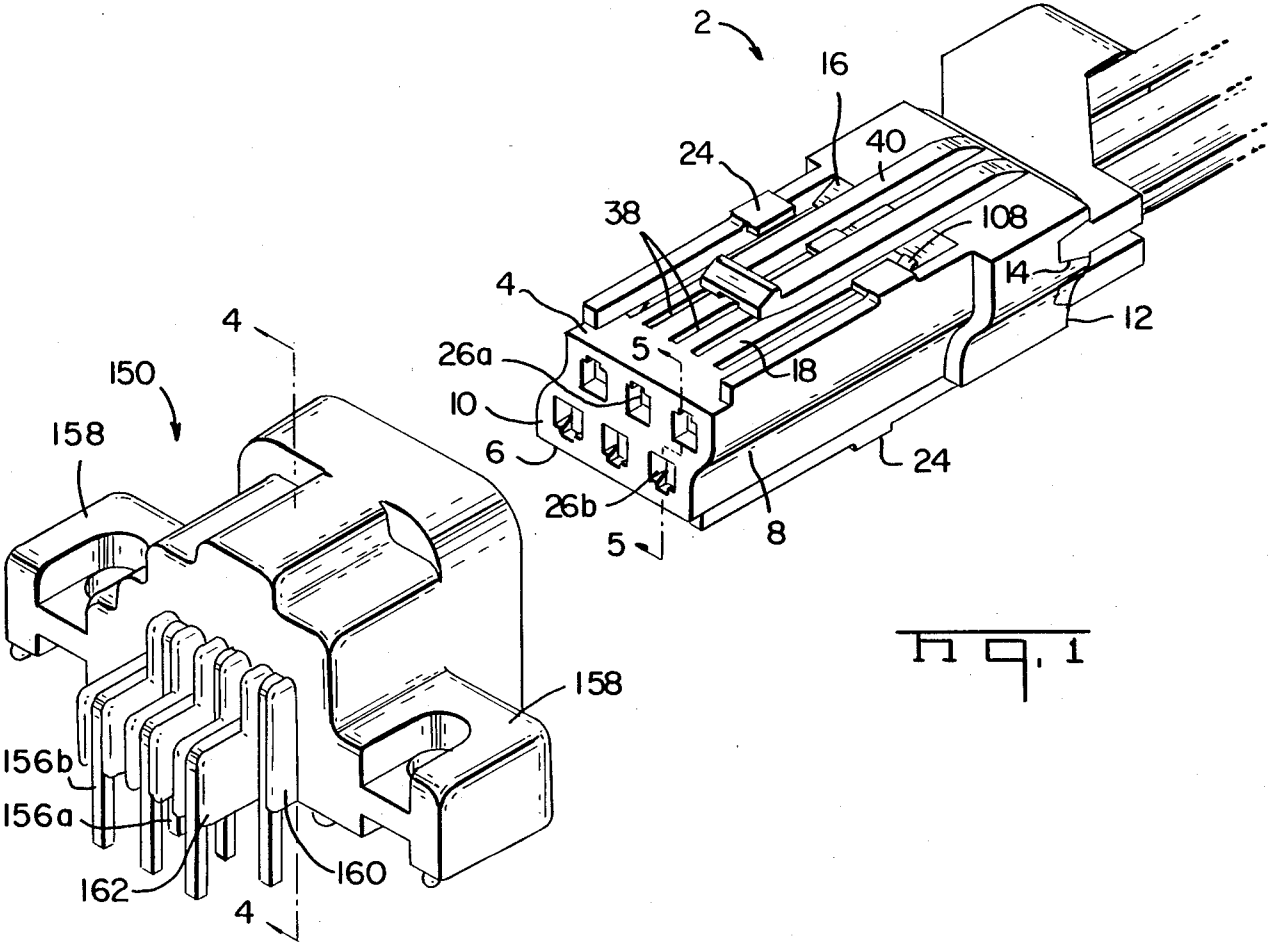
FIG. 1 is a perspective view of the receptacle and header.
Figure 2:
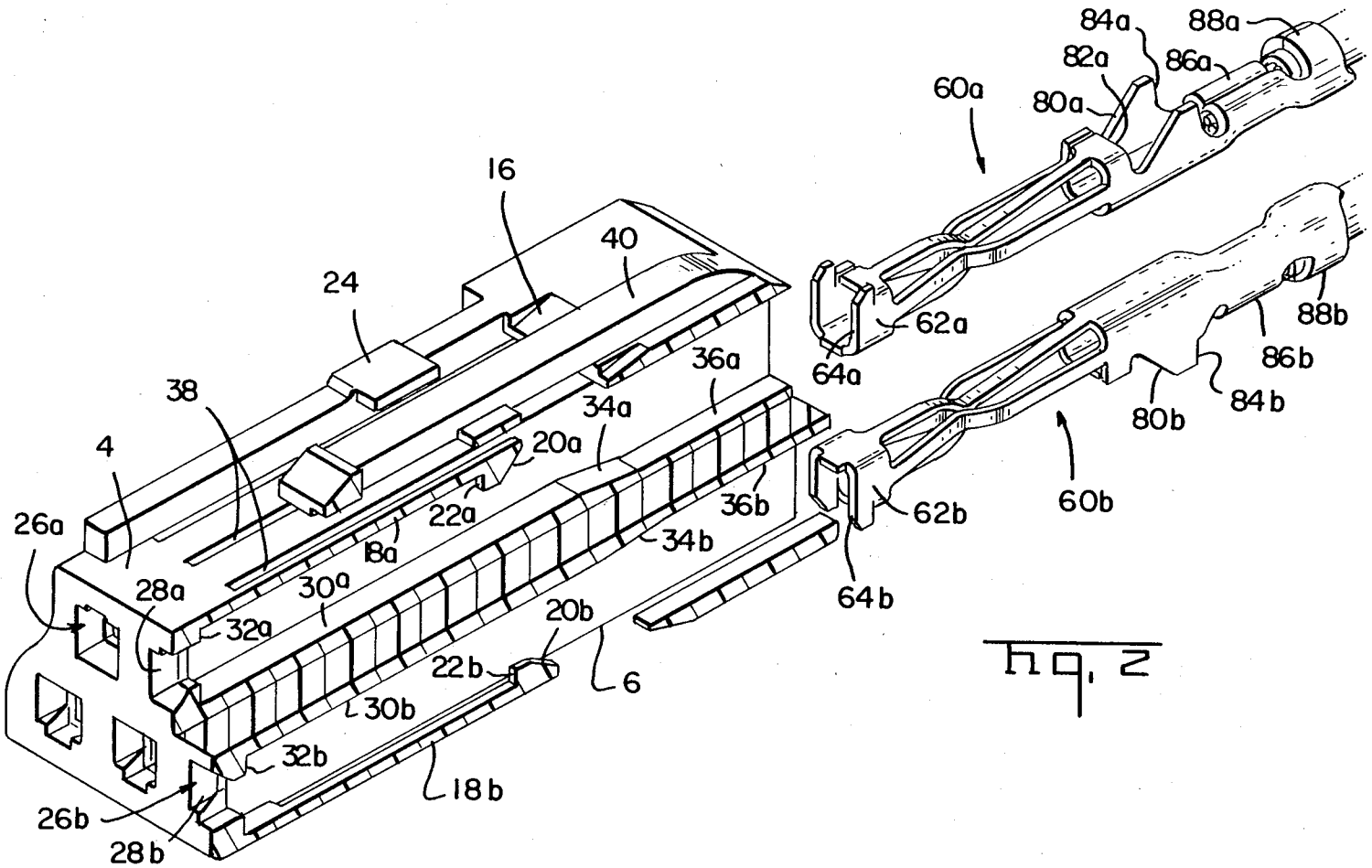
FIG. 2 is a persepctive view of the receptacle cutaway with the socket contacts exploded away.
Figure 7:
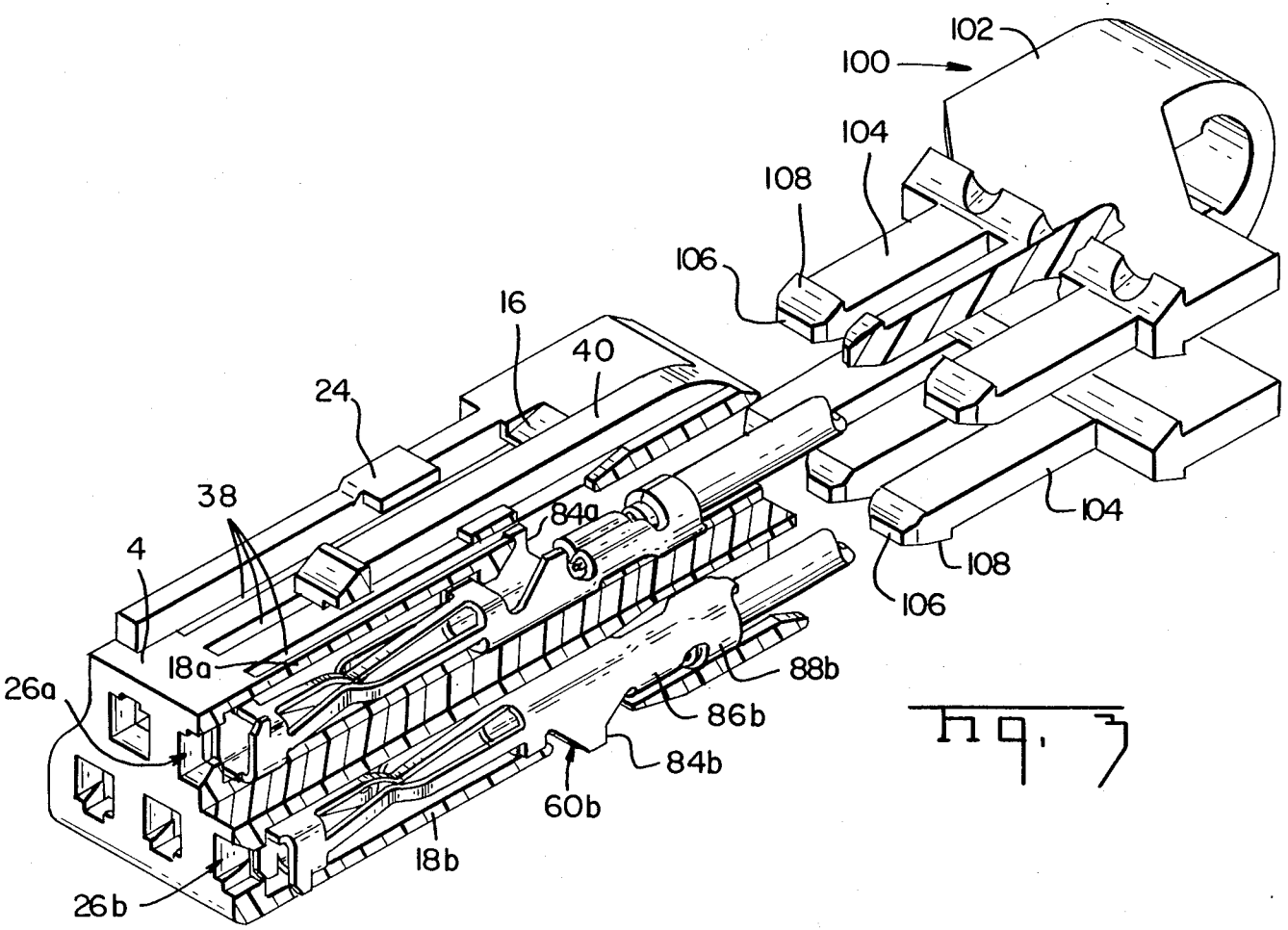
FIG. 7A is a cross-section of the contact through lines 7A—7A of FIG. 6.
FIG. 7B is a cross-section of the contact through lines 7B—7B of FIG. 6.
FIG. 7C is a cross-section of the contact through lines 7C—7C of FIG. 6.
FIG. 7D is a view similar to FIG. 7B with a post inserted.

Referring to FIG. 1 there is shown a high density socket contact receptacle 2 interconnectable with a header assembly 150. The receptacle 2 comprises a top wall 4, bottom wall 6, side walls 8, front mating face 10, and rear contact receiving face 12. Profiled in the contact receiving face 12 are insert receiving openings 14. Extending from the front mating face 10 and extending rearwardly to the rear contact receiving face are upper contact receiving apertures **26*a* and lower contact recieving apertures 26*b*. Overlying each of the top contact receiving apertures 26*a* is a latch member 18*a* as part of the top wall 4, each latch having a window 38 along each side. As best shown in FIG. 2, the latch member 18*a* includes a ramp surface 20*a* and a locking surface 22*a*. Still referring to FIG. 2, contact receiving aperture 26*a* includes a pin receiving chamfer 28*a*, a contact forward surface 32*a*, a first bore 30*a*, a frustoconical surface 34*a*, and a second bore 36*a*. The lower contact receiving aperture has like constituent components. As part of the bottom wall 6** and extending upwardly into the lower contact receiving apertures 26*b* are contact latches 18*b*. As best shown in FIG. 2, latch 18*b* includes a ramp surface 20*b* and locking surface 22*b*. Referring again to FIG. 1, receptacle 2 also includes anti-overstress features 24 for latches 18*a* and 18*b* and also a receptacle latch 40.

Referring to FIG. 3, the receptacle 2 is shown with the contacts 60*a*, 60*b* positioned within their respective apertures 26*a*, 26*b* and the terminal positioning insert 100 exploded away from the contact receiving face 12. The terminal positioning insert 100 includes a body portion 102, individual finger members 104, each finger 104 having a bearing surface 106 at its end. Each end finger 104 also includes a latch member 108.

Figure 6:
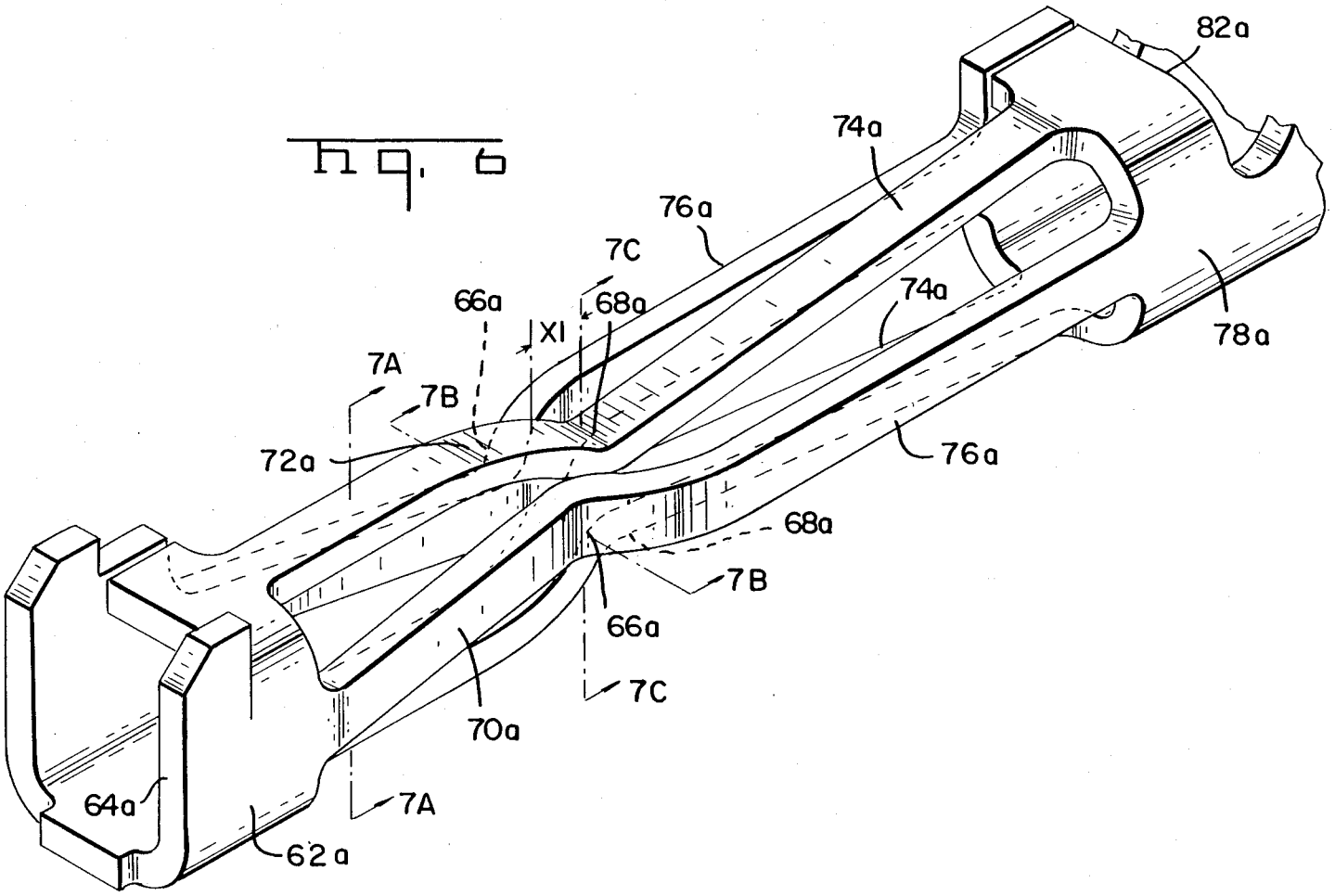
FIG. 6 is a perspective view of the preferred embodiment of the socket contact.

Referring now to FIG. 6, the contact 60*a* is shown in greater detail, although contact 60*b* has like constituent components. The contact 60*a* comprises a forward cylindrical portion 62*a*, a first constricted portion 66*a*, a second constricted portion 68*a* and a rear cylindrical portion 78*a*. As shown in FIG. 2, the contacts 60*a* also comprises a ramped surface 80*a*, a locking surface 84*a*, a wire terminating section 86*a*, and a strain relief portion 88*a*. Referring again to FIG. 6, the first constricted portion 66*a* includes two beams extending between the first cylindrical portion 62*a* and rearward cylindrical portion 78*a* formed inwardly and includes a straight portion 70*a* and a bowed section 76*a*. The second constricted portion 68*a* includes two beams extending between the first cylindrical portion 62*a* and the rearward cylindrical portion 78*a* including a bowed section 72*a* and a straight portion 74*a*. It should be noticed that the first constricted portion 66*a* includes a straight portion 70*a* extending from the forward cylindrical portion 62*a* whereas the second constricted portion 68*a* includes a bowed section 72*a* extending from the forward cylindrical portion 62*a*. It should also be noticed that the first constricted portion 66*a* includes a bowed section 76*a* extending from the second cylindrical portion 78*a* whereas the second constricted portion 68*a* includes straight section 74*a* extending from the second cylindrical portion 78*a*.

As shown in FIG. 2, to insert the contacts 60*a* into the housing 2, the top row of contacts 60*a* are inserted through the rear face 12 into the upper row of contact apertures 26*a*, the contact 60*a* sliding forward until the forward portion 64*a* abuts the forward face 32*a* within the contact aperture 26*a*. As the contact 60*a* begins rearward in the aperture 26*a*, the forward portion 62*a* contacts the ramped portion 20*a* of the contact latch 18*a*, causing the latch 18*a* to rise up and slide over the contact 60*a*. When the contact 60*a* is fully forward, the latch locks in place, surface 20*a* abutting surface 80*a* of the contact 60*a*, and surface 22*a* of latch 18*a* locked against surface 82*a* of contact 60*a*, as shown in FIG. 3. The lower row of contacts 60*b* are installed in the same manner as the upper row of contacts 60*a*, the contact forward portion 62*b* abutting the forward surface 32*b*, and latch 18*b* locked against locking surface 82*b*.

Figure 5:
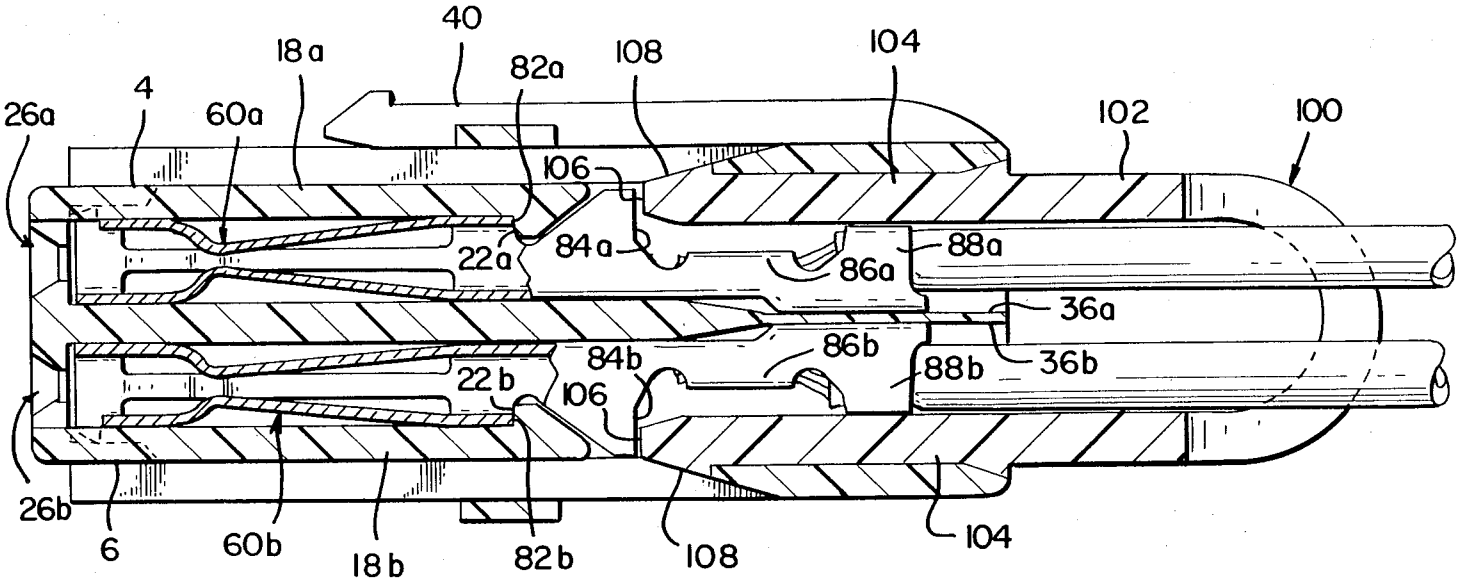
FIG. 5 is a cross-sectional view through lines 5—5 of FIG. 1.

To assure that the terminals 60*a*, 60*b* are fully forward within the respective apertures 26*a*, 26*b*, a terminal positioning insert 100 is employed. As best shown in FIG. 3, the insert 100 is installed from the rear of the housing, and inserted until the latches 108 locks into latching edge 16. When fully inserted, surfaces 106 bear against surfaces 84*a*, 84*b* of the contacts assuring that the contacts are fully forward, as shown in FIG. 5.

If the contacts 60*a*, 60*b* are to be removed, the insert latch 108 and the contact latches 18*a*, 18*b* are accessible from the exterior of the housing, as shown in FIG. 1, thus the contacts 60*a*, 60*b* are easily removed. To prevent overstressing the contact latches 18*a*, 18*b* by bending them too far outward, the housing includes anti-overstress members 24*a*, 24*b*, which limit the distance away from the housing the latches 18*a*, 18*b* may flex.

Figure 4:
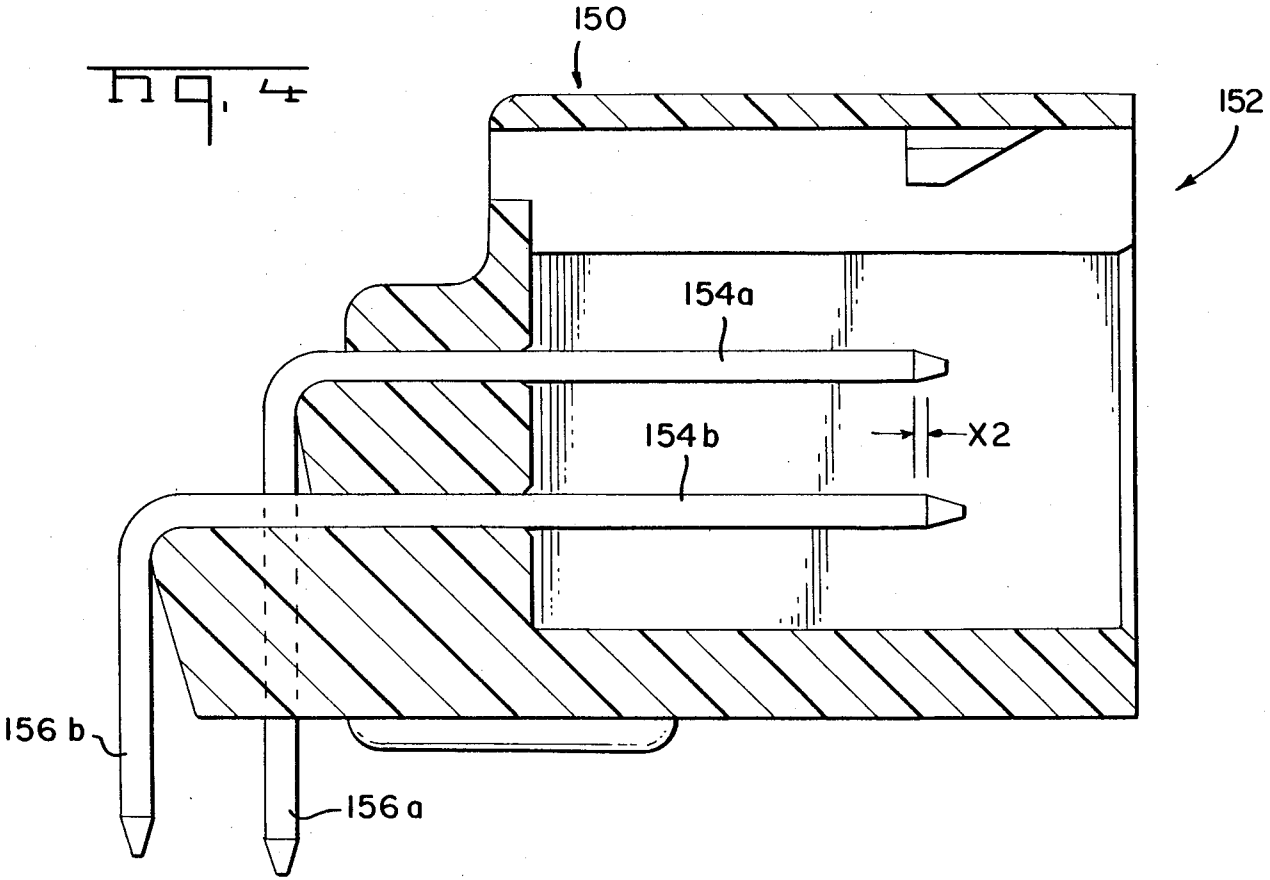
FIG. 4 is a cross-sectional view of the header through lines 4—4 of FIG. 1.

Once all contacts are loaded within the receptacle housing and the terminal positioning insert is in place, the receptacle is interconnectable with a header assembly such as 150, shown in FIG. 1. As the square posts 154*a*, 154*b*, as shown in FIG. 4, are dimensioned as small as 0.025 inches on a side, the contacts must be designed to make contact with the 0.025 inch square post with enough contact force to maintain electrical continuity.

Figures 7A, 7B, 7C, 7D:
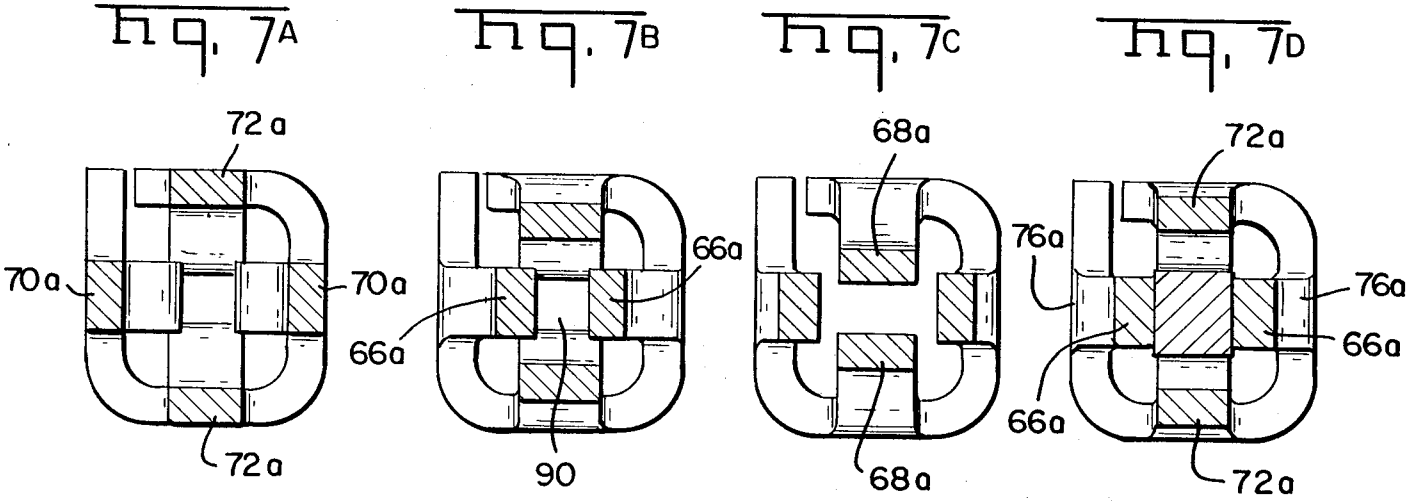

As designed, the first constricted portion 66*a* is axially offset by a distance $X_1$ from second constricted portion 68*a*, as shown in FIG. 6. This allows the constriction of each portion 66*a*, 68*a* to be closer to the axial centerline than possible had the constriction been at the same axial location. As shown in FIG. 7*b*, each beam section is wider than it could have been had the constriction been at the same axial position, resulting in a high normal force contact for a contact having a small envelope, resulting in a high density connector.

As shown in FIG. 7B, the contact opening 90 is square with each side smaller than the widths of the beam portions. Had the constriction of each pair of parallel beams been at the same axial opening, the width of each beam would have to be equal to or less than the width of the opening. As the beams are allowed to be wider, the contact force is kept high, which allows the contact envelope to be kept relatively smaller and thereby create a high density connector.

As the constricted portions 66*a*, 66*b* are closely spaced together, the normal force on a mating post is relatively high. As shown in FIGS. 7B and 7C, at the constrictions the spacing between the opposed beams is less than the width of the beams. Thus, the deflection of the beams when the post is inserted, is greater than the deflection of the beams in a design where the constrictions are at the same axial location. The increased deflection of the beams in the instant design relatively increases the normal force on the electrical post.

Also, as the constricted portions of the contacts are axially offset, and as the square post terminals within the header are also axially offset, the insertion force required to mate the header and receptacle is substantially reduced. It should be noted that in the preferred embodiment, the axial offset $X_2$ between the upper and lower pins 154*a* and 154*b*, respectively, is less than the axial offset $X_1$, between the constricted portions 66, 68, although the reverse situation could be arranged.

In most connectors which include a plurality of contacts mounted within a receptacle, all contacts mate with their respective pins or posts simultaneously. The force required to overcome the preload on the contents and to physically spread the beams apart, the insertion force, tends to be high, often causing the contacts, pins, or the latches within the housings which hold the contacts and pins in place to become overstressed. For example, a connector which includes 20 contacts mating with respective square posts 0.025 inches on a side would have a maximum insertion force of 32 pounds force, stabilizing to a sliding friction force of 20 pounds force.

Figure 9A:
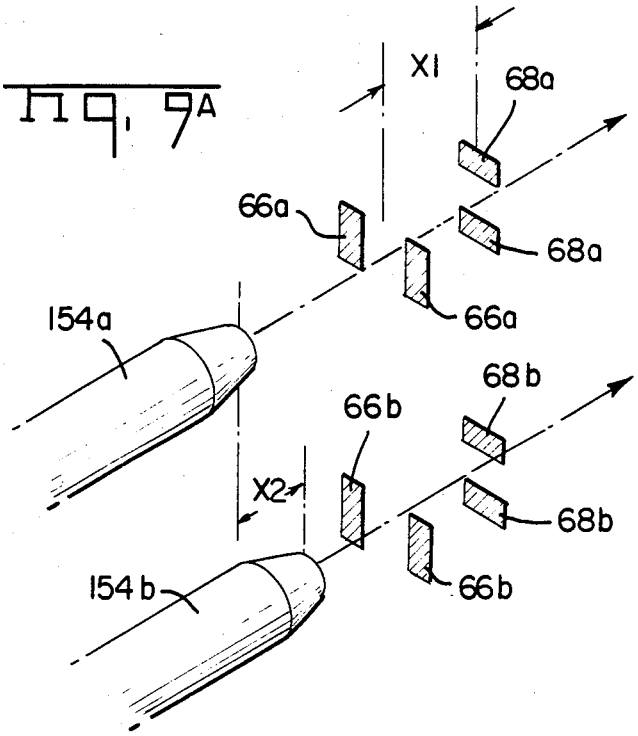
FIG. 9A is a diagrammatical view of the mating of the post and contact, showing instantaneous cross-sections of the first and second constricted portions.
Figure 9B:
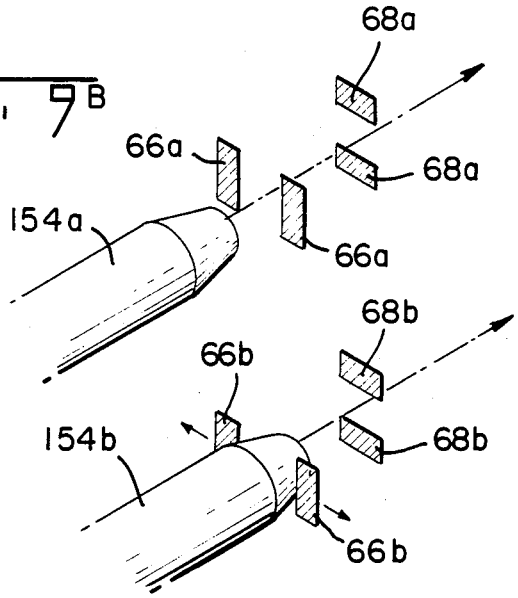
FIG. 9B is similar to FIG. 9A showing a first post mating with a lower first constricted portion.
Figure 9C:
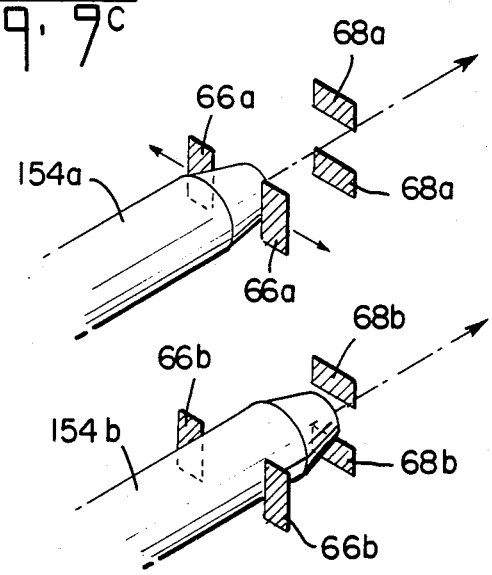
FIG. 9C is similar to FIG. 9A showing a second post mating with an upper first constricted portion.
Figure 9D:
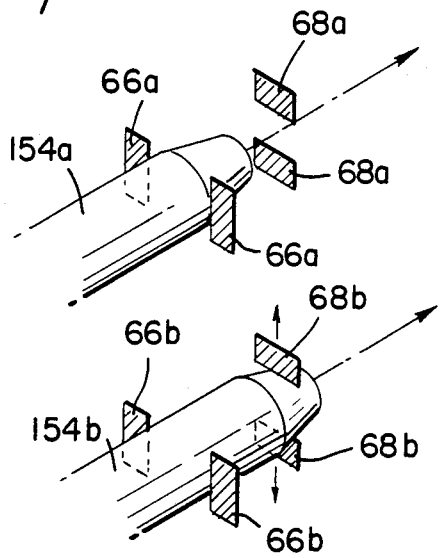
FIG. 9D is similar to FIG. 9A showing the first post mating with a lower second constricted portion.
Figure 9E:
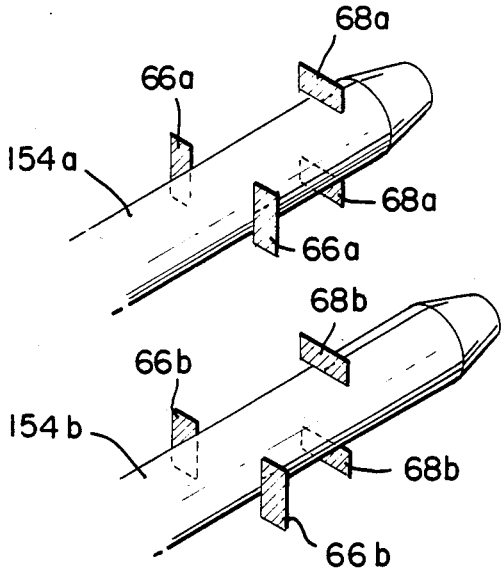
FIG. 9E is similar to FIG. 9A showing the second post mating with the upper second constricted portion.

In the instant design however, as the contricted portions 66, 68 and the posts 154*a*, 154*b* are axially staggered, the insertion force is in a stepped sequence. As shown in FIGS. 9A through 9E, the mating of the contact constricted portions 66, 68 and posts 154*a*, 154*b* is shown in diagrammatical fashion. FIG. 9A shows the posts 154*a*, 154*b* and constricted portions 66*a*, 68*a*, 66*b*, 68*b* aligned for insertion. As shown in FIG. 9B, 154 begins to contact the lower constricted portion 66*b*. Referring now to FIG. 9C, the upper post 154*a* begins to contact the first constricted portion 66a of the upper contact 60*a*. As shown in FIG. 9D, the lower post 154*b* begins to mate with consticted portion 68*b*. Finally, the upper post 154*a* mates with constricted portion 68*a* as shown in FIG. 9E. Using the same example as before, that is, a receptacle having 20 contacts mating with a header having 0.025 inch square posts, required a maximum total insertion force of 24.5 pounds force. The reduction in insertion force is due to the stepped sequence of mating the contacts and posts.

If the constricted portions of the contact are axially aligned, and if the header posts are also aligned, all posts hit the contact constricted portions simultaneously, causing the insertion forces of each post and contact combination to be additive. However, in the instant design, when the contact constricted portions are axially offset and when the header posts are axially offset, the posts hit the contacts in a four stepped sequence, as illustrated in FIGS. 9A–9E. After each contact and post are mated, the insertion force drops off to the sliding friction force of the mated contacts and posts. Thus, the maximum insertion force of the instant invention is the addition of the sliding friction force of all contacts and posts, and the force required to mate only the last posts and contacts of the four stepped sequence. In the prior art design where all posts and contacts hit simultaneously, the total insertion force is the addition of the sliding friction force of all contacts and posts mated and the force required to mate all posts and contacts simultaneously. Thus, the instant invention substantially reduces the maximum insertion force between the header and receptacle.

Figures 8, 8A:
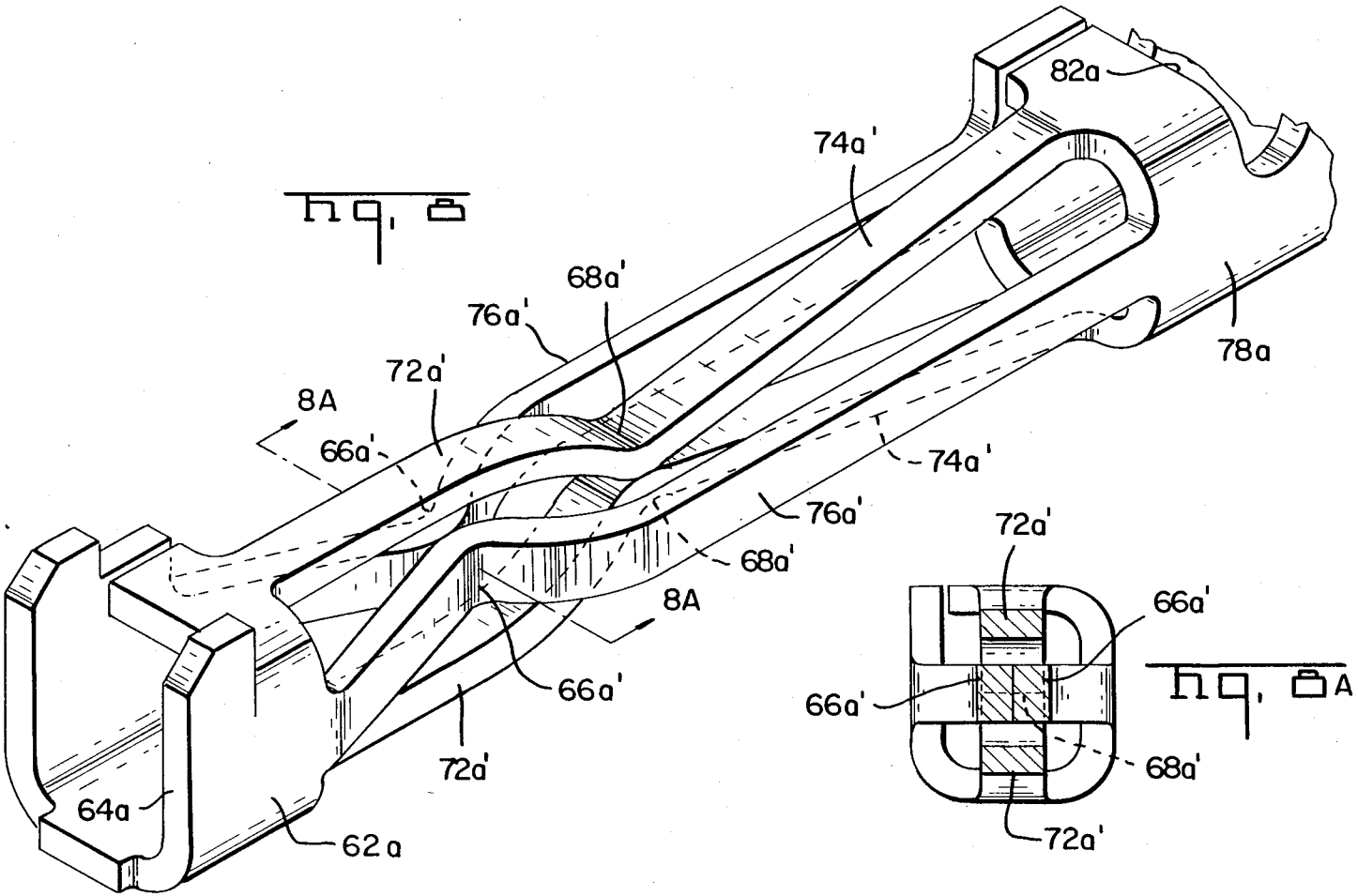
FIG. 8 is a perspective view of an alternate embodiment of the contact.
FIG. 8A is a cross-section through lines 8A—8A of FIG. 8.

Although the instant invention disclosed by way of a preferred embodiment, other embodiments are available. Particularly, the contact 60*a* although shown as having an axial offset $X_1$, as shown in FIG. 6, leaving a square opening 90 as shown in FIG. 7B, the constricted portions could actually be further offset axially to allow varied amounts of spacing. As shown in FIG. 8, the constricted portions could be axially offset to the extent where the opposing beams are actually contacting each other, leaving no opening at all, as shown in FIG. 8A. The altered components of the embodiment shown in FIGS. 8 and 8A refer to respective primed numerals.

What is claimed is:

1. A terminal for establishing an electrical contact with a single post in an array of closely spaced posts, the terminal comprising a stamped and formed member having a plurality of resilient beams surrounding the central axis of the terminal, each beam being inwardly formed to define a constricted portion intermediate the ends of each beam, the constricted portions of adjacent beams being axially offset to form axially offset points of contact with the same post, the spacing between each point of contact and the central axis of the terminal being less than the width of an adjacent beam thereby increasing the normal contact exerted by each beam, the terminal being characterized in that, the terminal includes two pairs of opposed beams with a first opposed pair having sections extending from a front pin receiving end to an intermediate section where the beams are defined as a first constricted portion, the first pair of opposed beams after the constricted portion each including an arcuately bowed section which extends to a rear wire receiving end of the terminal, the second pair of opposed beams including second arcuately bowed sections extending from the pin receiving end to a second constricted portion, the second pair of opposed beams after the second constricted portion extending to the wire receiving end, at least one pair of opposed beams including substantially straight sections extending between an end and a constricted portion.

2. The terminal of claim 1 wherein the pin receiving end is defined by a front cylindrical portion.

3. The terminal of claim 2 wherein the rear wire receiving end is defined by a rear cylindrical portion.

4. The terminal of claim 3 wherein the pairs of beams are integral with the front and rear cylindrical portions and extend therebetween.

5. The terminal of claim 1 wherein the constricted portions of respective beams are disposed between the arcuately bowed sections of oppositely directed beams.

6. The terminal of claim 1 wherein the sections of the first pair of opposed beams extending between the front pin receiving end and the constricted portion are substantially straight sections.

7. The terminal of claim 1 wherein the sections of the second opposed pair after the constricted portion are substantially straight sections.

8. A stamped and formed electrical socket for making connection with an electrical pin, the socket comprising:

a foraward cylindrical portion forming a pin entry;

a rearward cylindrical portion including means for making electrical connection with a conductor;

and a plurality of beam members extending between and integral with the forward and rearward cylindrical portions, each beam member having an opposed beam member forming pairs of beam members, each pair of beam members formed inwardly towards an axial centerline of the contact forming constricted portions, the constricted portions located at different axial positions with each pair of beam members being arcuately bowed at an axial position corresponding to the axial location of the constricted portion on the other beam members, at least one pair of opposed beam members including substantially straight sections extending between a cylindrical portion and a constricted portion.

9. The socket of claim 8 wherein a first pair of opposed beam members include substantially straight sections extending from the forward cylindrical portion to an intermediate section where the beam members are defined as first constricted portions, the beam members thereafter being arcuately bowed and extending to the rearward cylindrical portion.

10. The socket of claim 9 wherein a second pair of opposed beam members include second arcuately bowed sections extending from the forward cylindrical portion to a second constricted portion and thereafter continuing as straight sections.

* * * * *